US010571109B2

(12) United States Patent
Feng et al.

(10) Patent No.: US 10,571,109 B2
(45) Date of Patent: Feb. 25, 2020

(54) ILLUMINATING DEVICE

(71) Applicant: OSRAM GmbH, Munich (DE)

(72) Inventors: Yaojun Feng, Guangdong (CN); Yuanyuan He, Guangdong (CN); Hua Wang, Guangdong (CN); Zhian Li, Guangdong (CN)

(73) Assignee: LEDVANCE GMBH, Garching Bei München (DE)

( * ) Notice: Subject to any disclaimer, the term of this patent is extended or adjusted under 35 U.S.C. 154(b) by 45 days.

(21) Appl. No.: 14/402,111

(22) PCT Filed: May 23, 2013

(86) PCT No.: PCT/EP2013/060616
§ 371 (c)(1),
(2) Date: Nov. 19, 2014

(87) PCT Pub. No.: WO2013/174918
PCT Pub. Date: Nov. 28, 2013

(65) Prior Publication Data

US 2015/0109777 A1 Apr. 23, 2015

(30) Foreign Application Priority Data

May 23, 2012 (CN) ..... 2012 1 0162808

(51) Int. Cl.
*F21V 29/508* (2015.01)
*F21V 23/00* (2015.01)
(Continued)

(52) U.S. Cl.
CPC ..... *F21V 29/508* (2015.01); *F21V 5/048* (2013.01); *F21V 23/005* (2013.01); *F21V 29/83* (2015.01);
(Continued)

(58) Field of Classification Search
None
See application file for complete search history.

(56) References Cited

U.S. PATENT DOCUMENTS

2008/0049399 A1 2/2008 Lu et al.
2009/0185380 A1 7/2009 Ho et al.
(Continued)

FOREIGN PATENT DOCUMENTS

WO 2011089103 A1 7/2011
WO WO 2013/155684 A1 * 10/2013 ..... F21V 29/00

OTHER PUBLICATIONS

Printout of WO Patent Database page for WO 2013/174918 (PCT EP2013/060616) for OSRAM that was filed on May 23, 2013, printed Oct. 26, 2019, which indicates the PCT designated states and publication language.*

(Continued)

*Primary Examiner* — Sharon E Payne
(74) *Attorney, Agent, or Firm* — Hayes Soloway PC

(57) ABSTRACT

Various embodiments may relate to an illuminating device. The illuminating device includes a base having a partition board dividing the base into a first accommodating cavity and a second accommodating cavity, a circuit board having light sources and arranged in the first accommodating cavity, and an optical assembly arranged at an opening end of the first accommodating cavity. The partition board, the circuit board and the optical assembly each have at least one air communication structure to enable air from environment to flow into the first accommodating cavity and the second accommodating cavity.

20 Claims, 4 Drawing Sheets

(51) Int. Cl.

| | |
|---|---|
| ***F21V 5/04*** | (2006.01) |
| ***F21V 29/83*** | (2015.01) |
| *F21Y 105/10* | (2016.01) |
| *F21Y 115/10* | (2016.01) |

(52) U.S. Cl.
CPC ..... *F21Y 2105/10* (2016.08); *F21Y 2115/10* (2016.08)

(56) References Cited

U.S. PATENT DOCUMENTS

| | | | | |
|---|---|---|---|---|
| 2010/0133578 | A1* | 6/2010 | Pickard | F21V 29/004 257/99 |
| 2010/0165632 | A1* | 7/2010 | Liang | F21V 3/00 362/294 |
| 2011/0109216 | A1* | 5/2011 | Kang | F21V 29/004 313/45 |
| 2012/0182732 | A1* | 7/2012 | Moeck | F21S 8/088 362/235 |
| 2012/0300455 | A1 | 11/2012 | Breidenassel et al. | |
| 2013/0016511 | A1* | 1/2013 | Mansfield | F21K 9/00 362/244 |

OTHER PUBLICATIONS

Printout of WO Patent Database page for WO 2013/155684 published in Chinese on Oct. 24, 2013, printed on Oct. 26, 2019, which indicates the PCT designated states and publication language.*
International Search Report mailed in the international patent application PCT/EP2013/060616 dated Aug. 1, 2013.

* cited by examiner

ILLUMINATING DEVICE

RELATED APPLICATIONS

The present application is a national stage entry according to 35 U.S.C. § 371 of PCT application No.: PCT/EP2013/060616 filed on May 23, 2013, which claims priority from Chinese application No.: 201210162808.0 filed on May 23, 2012, and is incorporated herein by reference in its entirety.

TECHNICAL FIELD

Various embodiments generally relate to an illuminating device.

BACKGROUND

As everyone knows, LED illumination has irreplaceable advantages, such as energy saving, low power consumption, and electrical-to-optical conversion efficiency near to 100%. It can save no less than 80% energy and has a longer service lifetime compared with the traditional light source with the same illuminating efficiency. In view of the above advantages, the LED is used more and more as a light source such as a lot of LED retrofit lamps available in the market. Such LED retrofit lamps have the same appearance and profile as the traditional light source such as incandescent lamp, thus they can be more applicable to the existing illuminating systems as a light source. LED has been widely used in current illuminating device.

With the technology development, LED package itself can reach high efficiency, such as 140 lm/W for cold white and 90 lm/W for warm white and they are supposed to have a long lifetime as to 50,000 hours, but when the LED is integrated into a retrofit lamp together with an LED driver, a thermal management device and an optical component, the efficiency and the service lifetime of the retrofit lamp are highly dependent upon how to design the driver, the heat sink device and the optical component. Some of the electrical power consumed in the LED is converted to heat rather than light. According to statistics of U.S. Department of Energy, 75% to 85% of energy used to drive the LED is converted to heat, and the heat must be conducted from the LED die to the underlying PCB and heat sink device. If the heat cannot be conducted timely, the light output performance of the LED will be reduced and a color shift will be produced in a short term, and the service lifetime of the LED will be shortened in a long term.

Various heat sinks have been designed in order to improve the heat dissipating capability of the illuminating device. However, for the sake of industrial protection, the LED is usually arranged in a housing of the illuminating device or in an enclosed space of the heat sink, but the space between the lens and the circuit board bearing the LED is small, and effective air convection cannot be carried out in this space, thus, heat exchange between the LED as heat source and the outside is hindered, which reduces the heat dissipating performance of the illuminating device to a great extent, and further reducing the efficiency and the service lifetime of the illuminating device.

SUMMARY

Various embodiments provide an illuminating device. The illuminating device in accordance with the present disclosure may particularly well perform air convection with the environment and has excellent heat dissipating performance.

The illuminating device includes a base, the base having a partition board dividing the base into a first accommodating cavity and a second accommodating cavity; a circuit board having light sources and arranged in the first accommodating cavity; and an optical assembly arranged at an opening end of the first accommodating cavity, wherein the partition board, the circuit board and the optical assembly each have at least one air communication structure to enable air from environment to flow into the first accommodating cavity and the second accommodating cavity. In various embodiments, air from the environment can form an air communication passage, running through the whole illuminating device, by the air communication structures formed on the partition board, the circuit board and the optical assembly, so that heat from the light sources can be directly brought outwardly by convective air from inside of the illuminating device and the object of improving the heat dissipating performance of the illuminating device is achieved.

In various embodiments, the air communication structure of the partition board is configured as first openings, the air communication structure of the circuit board is configured as second openings, and the air communication structure of the optical assembly is configured as third openings, wherein the first openings, the second openings and the third openings form at least one air communication passage. By directly forming openings on the partition board, the circuit board and the optical assembly, the convective air can be enabled to directly flow into the inside of the illuminating device, so as to bring away heat from heat sources of the illuminating device. In addition, such simple opening configuration reduces the manufacturing difficulty of the illuminating device.

Preferably, the first openings and the second openings are configured as slots extending radially, respectively. Such slots reduce resistance of air when flowing inside the illuminating device to a great extent, and accelerate speed of air flow, as a result, the speed of heat exchange is enhanced and the heat dissipating performance of the illuminating device is further improved.

Advantageously, the first openings and the second openings have the same size. Since the circuit board should be disposed on the partition board in practical assembling, no projection hindering air flow is present between the first openings and the second openings that have the same size, which decreases the resistance of air when flowing inside the illuminating device and accelerates the speed of air flow and further the speed of heat exchange, and improves the heat dissipating performance of the illuminating device.

Preferably, the third openings are configured as holes, wherein respective first opening and respective second opening is assigned to at least two third openings. Since the third openings configured as holes are opened on the optical assembly, and the optical assembly directly faces the outside environment, small holes can prevent, to some extent, external pollutants from flowing into the inside of the illuminating device. In addition, in various embodiments, the first opening, the second opening and the third opening in the same air communication passage should be on the same straight line, that is to say, they are aligned with each other. The convective air from the environment can pass through these openings in sequence and will not be blocked, which accelerates the speed of air flow, and improves the heat exchange capability and the heat dissipating performance.

In various embodiments, the circuit board is configured to include a plurality of first blade portions, the light sources are arranged on the first blade portions, and the air communication structure of the circuit board is configured as first cuts between the first blade portions. In addition, the optical assembly is configured to include a plurality of second blade portions, and the air communication structure of the optical assembly is configured as second cuts between the second blade portions, wherein the first cuts and the second cuts have the same size, and the second blade portions are enclosed by the first blade portions, respectively, to define enclosed spaces for accommodating respective light sources. In various embodiments, a plurality of independent closed spaces is defined by the optical assembly and the circuit board, and each enclosed space is arranged with at least one light source. Heat emitted from these light sources will not interfere other light sources. Moreover, such configuration of independent enclosed spaces elevates the industrial protection level of the illuminating device of the present disclosure. At the same time, the convective air from environment can directly flow through a cut defined by one first cut and one second cut formed between adjacent enclosed spaces and bring away heat generated by the light sources in respective independent enclosed spaces.

Preferably, the air communication structure of the partition board is configured as first openings extending radially, the first openings, the first cuts and the second cuts form at least one air communication passage, through which, air from the environment can further flow into the second accommodating cavity of the illuminating device so as to bring away heat emitted from the heat sources in said accommodating cavity.

Optionally, third cuts are opened on a base wall of the base defining the first accommodating cavity, and the third cuts extend from the opening end of the base to the partition board. In various embodiments, angular positions of the third cuts in a circumferential direction of base are corresponding to angular positions of the respective first openings in the circumferential direction, thus, air from the environment can more freely flow into between the first cuts and the second cuts in a lateral direction of the base wall, which improves the air convection capability and the heat dissipating effect of the illuminating device in accordance with the present disclosure.

Preferably, the base is configured as a housing or a heat sink of the illuminating device, the optical assembly is lens, and the light sources are LED chips.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form a part hereof, and in which is shown by way of illustration specific embodiments in which the disclosure may be practiced. In this regard, directional terminology, such as "top", "bottom", "front", "back", "laterally", is used in reference to the orientation of the figures being described. Because components of embodiments of the present disclosure can be positioned in a number of different orientations, the directional terminology is used for purposes of illustration and is in no way limiting. It is to be understood that other embodiments may be utilized and structural or logical changes may made without departing from the scope of the present disclosure. The following detailed description, therefore, is not to be taken in a limiting sense, and the scope of the present disclosure is defined by the appended claims.

Figure 1:
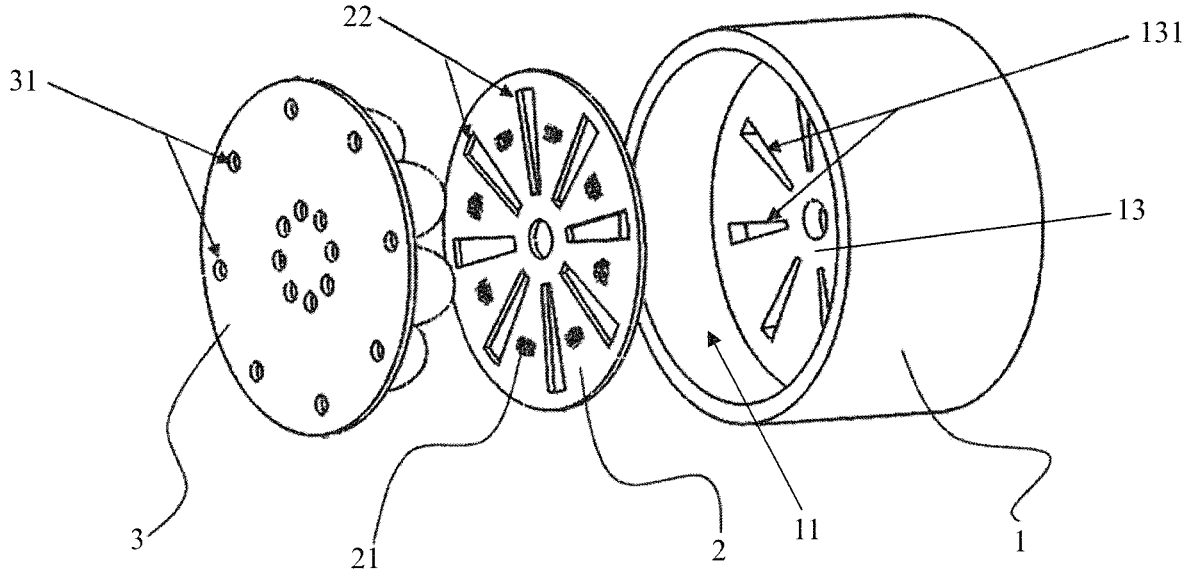
FIG. 1 is an exploded schematic diagram of a first embodiment of an illuminating device in accordance with the present disclosure.

FIG. 1 is an exploded schematic diagram of a first embodiment of an illuminating device 100 in accordance with the present disclosure. It can be seen from FIG. 1 that the illuminating device 100 in accordance with the present disclosure includes: a base 1, the base 1 having a partition board 13 dividing the base 1 into a first accommodating cavity 11 and a second accommodating cavity 12 (see FIG. 2); a circuit board 2 having light sources 21 and being arranged in the first accommodating cavity 11: and an optical assembly 3 arranged at an opening end of the first accommodating cavity 11, and wherein the partition board 13, the circuit board 2 and the optical assembly 3 each have at least one air communication structure to enable air from environment to flow into the first accommodating cavity 11 and the second accommodating cavity 12. In the present embodiment, the air communication structure of the partition board 13 is configured as first openings 131, the air communication structure of the circuit board 2 is configured as second openings 22, and the air communication structure of the optical assembly 3 is configured as third openings 31, wherein the first openings 131, the second openings 22 and the third openings 31 form at least one air communication passage.

In addition, it can be seen from FIG. 1 that the first openings 131 and the second openings 22 are configured as slots extending radially. The first openings 131 and the second openings 22 have the same size. In a situation of completing practical assembling, since the circuit board 2 is placed on the partition board 13, the first opening 131 and the second opening 22 actually jointly form one opening with each other, and since the first openings 131 and the second openings 22 are configured as slots, flowing resistance of convective air inside the illuminating device 100 is reduced as much as is possible, accelerating the flowing speed of the convective air and improving the heat exchanging capability.

In addition, in the first embodiment shown in FIG. 1, the third openings 31 formed on the optical assembly 3 are configured as holes. In the present embodiment, one first opening 131, one second opening 22 and two third openings 31 form one air communication passage, that is to say, each first opening 131 and each second opening 22 in each air communication passage are correspondingly provided with two third openings 31. These third openings 31 configured as holes, on one hand, satisfy requirements of convective air flowing into or flowing out from the inside of the illuminating device 100, and on the other hand, prevent external pollutants from flowing into the inside of the illuminating device 100 to some extent, because it is hard for external pollutants to pass through the small-sized holes to flow into inside of the illuminating device 100. Of course, in order to further improve the convective capability of the illuminating device 100 in accordance with the present disclosure, each first opening 131 and each second opening 22 also can be correspondingly provided with more third openings 31, e.g. three or four third openings 31.

Figure 3:
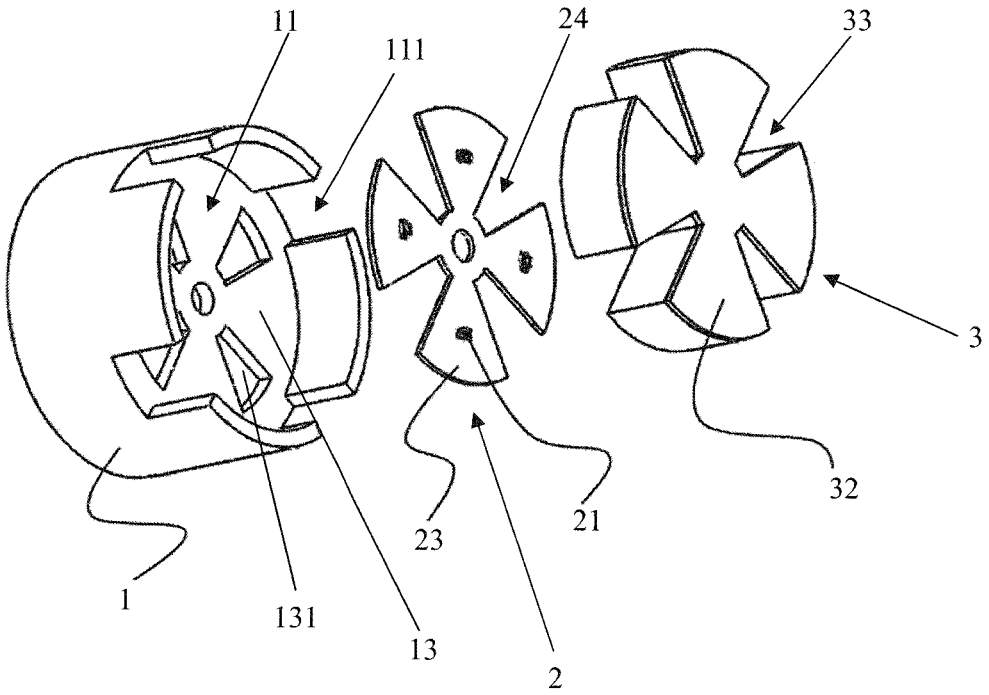
FIG. 3 is an exploded schematic diagram of a second embodiment of the illuminating device in accordance with the present disclosure.

In the first embodiment of the illuminating device 100 in accordance with the present disclosure as shown in FIG. 1 and the second embodiment of the illuminating device 100 in accordance with the present disclosure as further described in FIG. 3, the base 1 is configured as a housing of the illuminating device 100, and of course, the base 1 also can be configured as a heat sink of the illuminating device 100 according to requirements, the optical assembly 3 is configured as lens, and the light sources 21 are configured as LED chips, and of course, the light sources 21 also can be other types of light sources, such as Xenon lamp or halogen lamp. The above specific definitions of the base 1, the optical assembly 3 and the light sources 21 are merely used to help understanding the present disclosure without limiting the technical solutions of the present disclosure.

Figure 2:
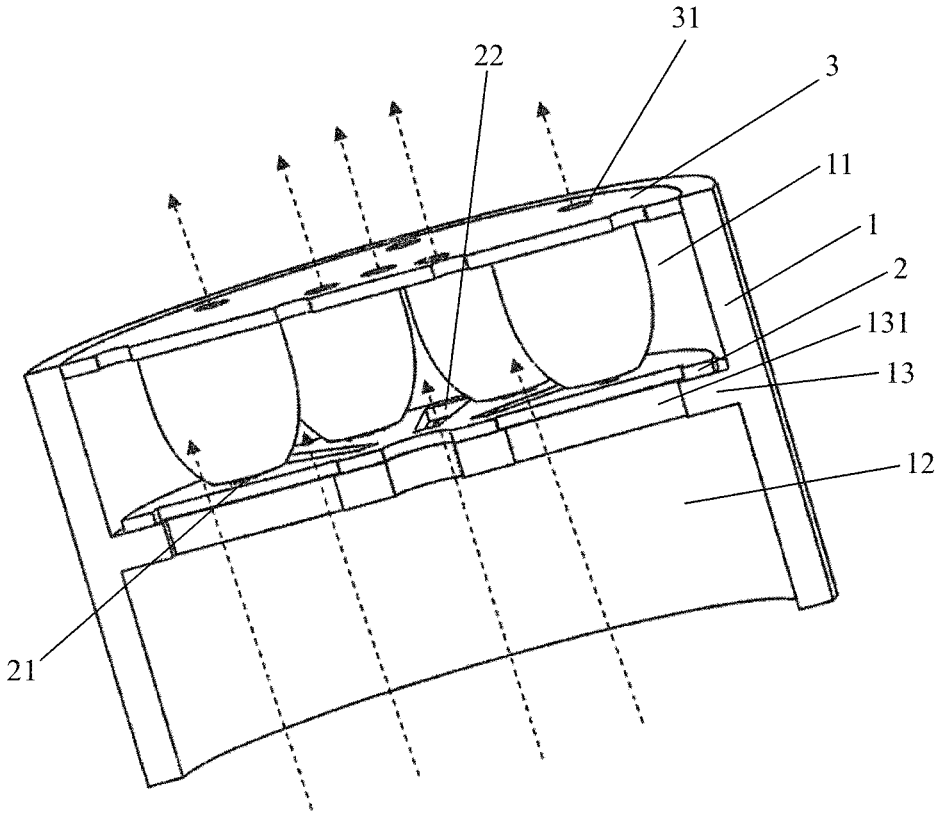
FIG. 2 is a cross-sectional view of the illuminating device as shown in FIG. 1.

FIG. 2 is a cross-sectional view of the illuminating device 100 as shown in FIG. 1. It can be seen clearly from said cross-sectional view the positional relations between various components in an assembled state of the illuminating device 100. The circuit board 2 arranged with the light sources 21 is directly arranged on the partition board 13 formed in one piece with the base 1. The second openings 22 formed on the circuit board 2 and the first openings 131 formed on the partition board 13 are aligned with each other, respectively. In addition, third openings 31 are opened on the optical assembly 3, wherein each of the first openings 131 and each of the second openings 22 are corresponding to two third openings 31. Further, it can be seen from arrows in FIG. 2 flowing directions of air. Convective air from environment flows into the second accommodating cavity 12, and then passes through the first openings 131 on the partition board 13 and the second openings 22 on the circuit board 2 to flow into the first accommodating cavity 11. The convective air brings away heat dissipated from the light sources 21 in the first accommodating cavity 11 and discharges the same to external environment through the third openings 31 on the optical assembly 3. Certainly, the convective air also can flow in a reverse direction, i.e. the convective air flows into the first accommodating cavity 11 from the third openings 3, and then passes through the second openings 22 and the first openings 131 to flow into the second accommodating cavity 12, and further is discharged into the external environment.

FIG. 3 is an exploded schematic diagram of a second embodiment of the illuminating device in accordance with the present disclosure. It can be seen from FIG. 3 that the circuit board 2 is configured to include a plurality of blade portions 23 similar to structure of fan blade, the light sources 21 are arranged on the first blade portions 23, and the air communication structure of the circuit board 2 is configured as first cuts 24 between the first blade portions 23. The optical assembly 3 is configured to include a plurality of second blade portions 32, and the air communication structure of the optical assembly 3 is configured as second cuts 33 between the second blade portions 32. The optical assembly 3 in accordance with the present disclosure is configured as lens as mentioned in the preceding. The cross section of the optical assembly 3 is configured to be blade-shaped, as a result, the optical assembly 3, as viewed on the whole, includes a plurality of blade portions 32 having a certain thickness. In addition, it may be seen further from FIG. 3 that the first cuts 24 and the second cuts 33 have the same size, and the second blade portions 32 are enclosed by the first blade portions 23, respectively, so as to define enclosed spaces for accommodating respective light sources 21. In the present embodiment, the lens as the optical assembly 3 actually includes a top surface and a circumferential wall extending from edges of the top surface, so that a cover-shaped structure is formed. The first blade portions 23 actually close the cover-shaped opening end of the optical assembly 3, so that enclosed spaces are formed.

It can be seen further from FIG. 3 that the air communication structure of the partition board 13 is configured as first openings 131 extending radially. Said first openings 131 have no difference from the first openings 131 in the embodiment as shown in FIG. 1. In the present embodiment, respective first opening 131 has a profile matching that of respective first cut 24 and that of respective second cut 33, so that the first openings 131, the first cuts 24 and the second cuts 33 form a smooth air communication passage. Moreover, third cuts 111 are formed on a base wall of the base 1 defining the first accommodating cavity 11, and the third cuts 111 extend from the opening end of the base 1 to the partition board 13. angular positions of the third cuts 111 in a circumferential direction of base are corresponding to angular positions of the respective first openings 131 in the circumferential direction, thus, after the optical assembly 3 is mounted into the first accommodating cavity 11 of the base 1 of the illuminating device 100, a mouth of a groove jointly formed by the first cut 24 and the second cut 33 of the optical assembly 3, opened to the base wall, will not be blocked by the base wall to further hinder air flowing.

Figure 4:
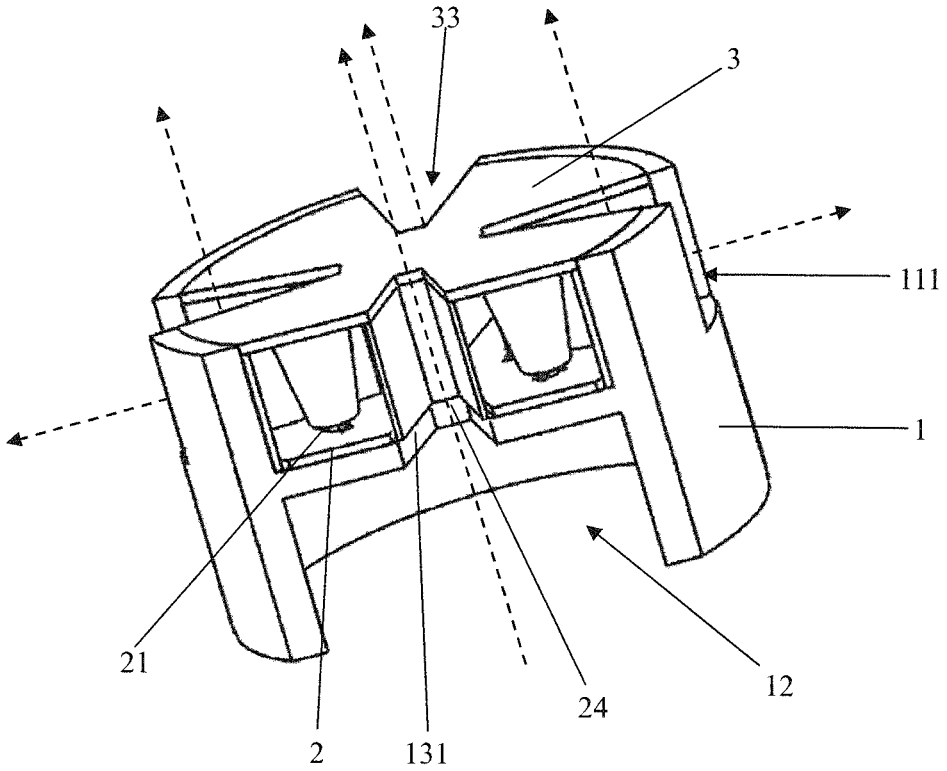
FIG. 4 is a cross-sectional view of the illuminating device as shown in FIG. 3.

FIG. 4 is a cross-sectional view of the illuminating device as shown in FIG. 3. It can be seen from FIG. 4 that the lens as the optical assembly 3 is buckled with the circuit board 2 so that a plurality of independent enclosed spaces are formed between the optical assembly 3 and the circuit board 2. The light sources 21 are arranged in said enclosed spaces, respectively. In an assembled state, the optical assembly 3 is completely inserted into the first accommodating cavity 11 of the base 1, and the first openings 131, the first cuts 24, the second cuts 33 and the third cuts 111 are aligned with each other, respectively, so as to form a smooth air communication passage. Arrows in FIG. 4 show a flowing direction of the convective air, that is to say, the convective air from environment flows into the second accommodating cavity 12, and then passes through the first openings 131 to flow into between the first cuts 24 and the second cuts 23, and is discharged upwardly and laterally passing though the third cuts 111. Of course, the flowing direction of the convective air also can be reversed. The illuminating device 100 in accordance with the present embodiment not only has good heat dissipating performance but also has high industrial protection level.

It is to be understood that the features of the various exemplary embodiments described herein may be combined with each other, unless specifically noted otherwise.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 base
11 first accommodating cavity

111 third cut
12 second accommodating cavity
13 partition board
131 first opening
2 circuit board
21 light source
22 second opening
23 first blade portion
24 first cut
3 optical assembly
31 third opening
32 second blade portion
33 second cut
100 illuminating device

The invention claimed is:

1. An illuminating device comprising:

a base having a hollow interior region divided by a partition board into a first accommodating cavity and a second accommodating cavity, wherein the partition board has a first air flow communication feature provided as one or more first openings formed in the partition board;

a circuit board having at least one light source populated thereon, wherein the circuit board is arranged in the first accommodating cavity, and wherein the circuit board has a second air flow communication feature provided as one or more second openings formed in the circuit board; and an optical assembly configured as a lens, wherein the optical assembly is arranged at an opening end of the first accommodating cavity, and wherein the optical assembly has a third air flow communication feature provided as one or more third openings formed in the optical assembly;

wherein the first, second, and third air flow communication features are directly linearly aligned with one another so as to form together at least one air flow communication passageway configured to enable air from a surrounding environment to flow into the first accommodating cavity and the second accommodating cavity.

2. The illuminating device according to claim 1, wherein the one or more first openings and the one or more second openings are configured as radially extending slots.

3. The illuminating device according to claim 2, wherein the one or more first openings and the one or more second openings have the same size.

4. The illuminating device according to claim 2, wherein the one or more third openings are configured as one or more holes.

5. The illuminating device according to claim 1, wherein the base is configured as at least one of a housing and a heat sink of the illuminating device.

6. The illuminating device according to claim 1, wherein the circuit board is mounted to the partition board and located between the partition board and the optical assembly.

7. The illuminating device according to claim 1, wherein a single first opening, a single second opening, and at least two third openings together form one air flow communication passageway for the illuminating device.

8. The illuminating device according to claim 1, wherein at least one first opening, at least one second opening, and at least two third openings are directly linearly aligned with one another such that air is permitted to pass therethrough without blockage.

9. An illuminating device comprising:

a base having a hollow interior region divided by a partition board into a first accommodating cavity and a second accommodating cavity, wherein the partition board has a first air flow communication feature provided as one or more first openings formed in the partition board;

a circuit board having at least one light source populated thereon, wherein the circuit board is arranged in the first accommodating cavity, wherein the circuit board includes a plurality of first blade portions on which the at least one light source is populated, and wherein the circuit board has a second air flow communication feature provided as first cuts between the first blade portions; and an optical assembly configured as a lens, wherein the optical assembly is arranged at an opening end of the first accommodating cavity, wherein the optical assembly includes a plurality of second blade portions, and wherein the optical assembly has a third air flow communication feature provided as second cuts between the second blade portions;

wherein the first, second, and third air flow communication features are directly linearly aligned with one another so as to form together at least one air flow communication passageway configured to enable air from a surrounding environment to flow into the first accommodating cavity and the second accommodating cavity.

10. The illuminating device according to claim 9, wherein the first cuts and the second cuts have the same size.

11. The illuminating device according to claim 9, wherein the one or more first openings are configured as radially extending slots.

12. The illuminating device according to claim 11, wherein the one or more first openings, the first cuts, and the second cuts have the same size.

13. The illuminating device according to claim 9, wherein the first blade portions interface with the second blade portions to define enclosed spaces accommodating the at least one light source.

14. The illuminating device according to claim 9, wherein the base is configured as at least one of a housing and a heat sink of the illuminating device.

15. The illuminating device according to claim 9, wherein the circuit board is mounted to the partition board and located between the partition board and the optical assembly.

16. The illuminating device according to claim 9, wherein a single first opening, a single first cut, and a single second cut together form one air flow communication passageway for the illuminating device.

17. The illuminating device according to claim 9, wherein at least one first opening, at least one first cut, and at least one second cut are directly linearly aligned with one another such that air is permitted to pass therethrough without blockage.

18. The illuminating device according to claim 9, wherein the base has a fourth air flow communication feature provided as third cuts formed in a sidewall of the base defining the first accommodating cavity.

19. The illuminating device according to claim 18, wherein the third cuts extend from the opening end of the base to the partition board.

20. The illuminating device according to claim 18, wherein the third cuts are angularly positioned corresponding with the one or more first openings.

* * * * *